United States Patent [19]

Cox et al.

[11] 4,135,340

[45] Jan. 23, 1979

[54] MODULAR DRILL RIG ERECTION SYSTEMS

[75] Inventors: David F. Cox; Tom T. Hashimoto, both of Victoria, Tex.

[73] Assignee: Chloride Group Limited, London, United Kingdom

[21] Appl. No.: 775,558

[22] Filed: Mar. 8, 1977

[51] Int. Cl.[2] ..... E04H 12/34; E21C 5/00

[52] U.S. Cl. ..... 52/115; 52/122; 173/151

[58] Field of Search ..... 52/115–122, 52/745, 741; 173/151

[56] References Cited

U.S. PATENT DOCUMENTS

| | | | |
|---|---|---|---|
| 3,271,915 | 9/1966 | Woolslayer et al. | 52/122 |
| 3,807,109 | 4/1974 | Jenkins et al. | 173/151 X |
| 3,922,825 | 12/1975 | Eddy et al. | 173/151 X |

*Primary Examiner*—J. Karl Bell

*Attorney, Agent, or Firm*—Watson Cole Grindle & Watson

[57] ABSTRACT

A system for erecting elevated floors where a first support floor with a drawworks thereon is connected to one end of a base structure by two pair of parallel spaced pivotable links and a second support floor is coupled to the opposite end of the base structure and by two pair of parallel spaced pivotable links. In accordance with the invention a strong back is erected about midway of the length of the base forming a rigid frame and supporting elevated sheaves at each side of the base structure. A pair of cables are adapted to pass over said sheaves, one on each side of said base structure and connect first to said first floor for erection and then to said second floor for erection.

6 Claims, 6 Drawing Figures

MODULAR DRILL RIG ERECTION SYSTEMS

BACKGROUND OF THE INVENTION

The present invention relates to drilling rigs and more particularly the erection of a high floor modular drilling rig.

In the drilling of exploratory wells such as oilwells, rigs are employed which can be transported to a site and assembled in place to perform the drilling operation. It is necessary to provide elevated drill floors to provide a space thereunder for equipment such as safety devices, blowout preventers, and the like. The rig must have a base suitable to support the rig on infirm soil so that the weight of the rig and the drilling equipment will be distributed over the base area for transfer to the earth.

According to the present invention, a drilling rig has a base for placement on the ground at a well site with a floor structure supported on parallel spaced legs pivotally attached between a floor structure and said base for allowing said floor structure to move from a low position on said base to an elevated position above said base by rotation of said legs to a vertical position. A pair of strong back towers are provided one on each side of the base near midway the length thereof with sheave means supported at the top of each tower with the axes thereof transverse the length of the base. Sheaves on each side of said floor structure have cables passing successively each sheave on said floor structure and over sheaves on the towers. Hydraulic means on each side of said base powers the cables to pull the floor structure to an elevated position adjacent said towers.

Preferably a pair of sheaves are mounted on each side of the base over which each cable passes. The hydraulic means comprise cylinders mounted on the base each connected to two ends of each cable for pulling the cables through the sheaves to raise the floor structure.

BRIEF DESCRIPTION OF THE DRAWINGS

The advantages and features of the improved modular rig of the present invention will be more readily appreciated by those of ordinary skill in the art as disclosure thereof is made in the following description by reference to the accompanying drawings, in which.

DETAILED DESCRIPTION

Figure 1:
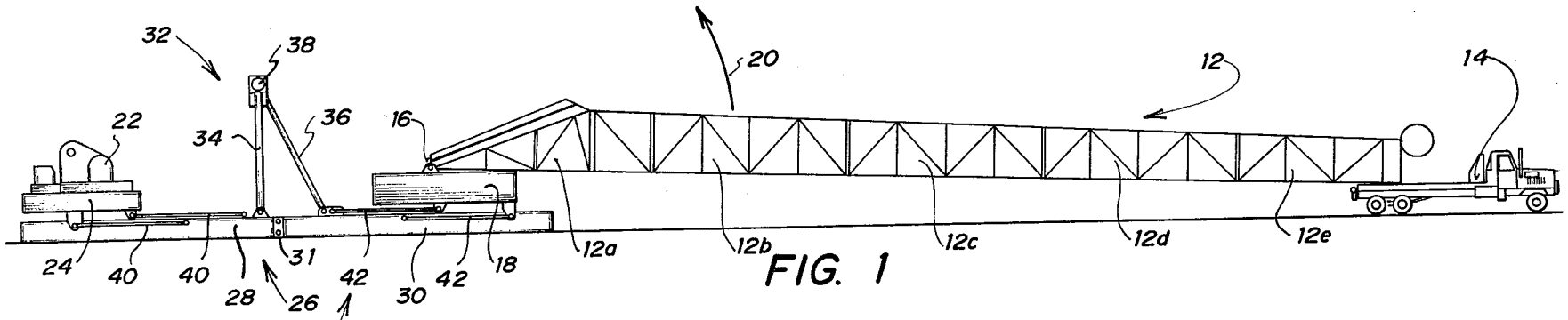
FIG. 1 is a side elevation of the improved modular drill rig embodying the present invention showing a base structure assembled and in place with support floors for the drawworks and most assembled and connected to the base structure with a strong back in place prior to raising the support floors with the upper end of the mast supported from a flat bed truck.

In the drawings, like reference characters designate like or corresponding parts throughout the several views. There is illustrated in FIG. 1, a modular drilling rig 10 shown as having a mast 12 supported at its upper end by a flat bed truck 14. The mast 12 is constructed from transportable sections 12*a, b, c, d* and *e* which are attached together. The mast 12 is pivotally coupled at 16 to the support floor 18 for rotation in the direction of arrow 20 to a vertical position. A drawworks assembly 22 is carried on a drawworks support floors 24.

A base structure 26 is formed from two halves 28 and 30 pinned together at 31. Base structure assembly 26 rests upon the earth surface for supporting the rig 10. Base structure 26 is constructed to distribute the weight of the rig on the earth surface. Distribution of weight through the base structure is important particularly when operating the rig at a site where the surface is soft or infirm.

Figure 2:
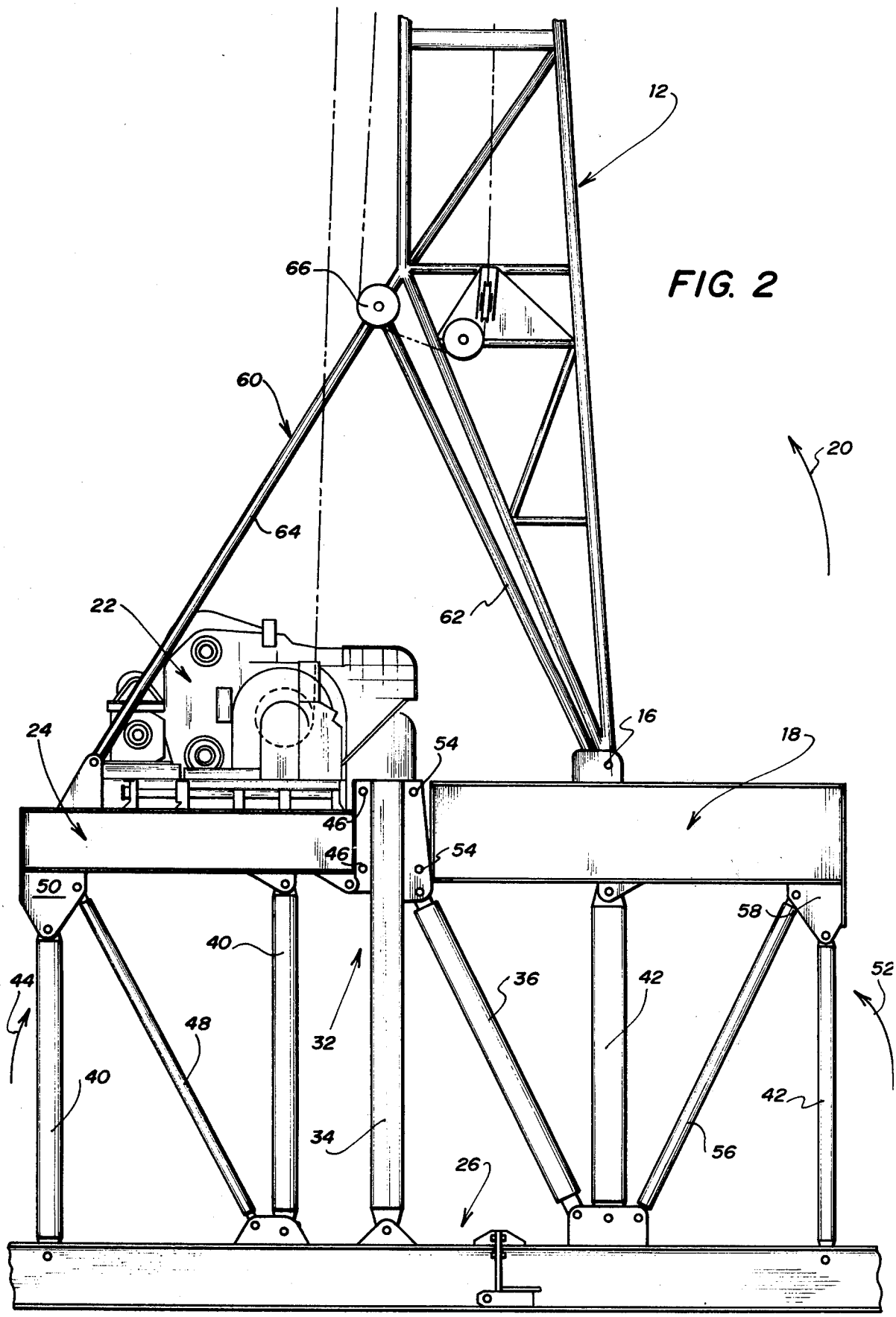
FIG. 2 is an enlarged partial side elevation of the modular drilling rig of FIG. 1 after erection.

A strong back 32 has legs 34 and 36 which are connected, respectively, to halves 28 and 30. Leg 34 is vertical and leg 36 extends at an angle from leg 34. Strong back 32 has such structure as shown in FIGS. 1 and 2 on both sides of base 26 and is braced laterally to provide rigid fixed but short towers for use in erecting floors 18 and 24. Assembly 32 supports sheaves 38 in an elevated position as shown in FIG. 1.

Drawworks support floor 24 is coupled to base structure 26 by means of two pair of parallel spaced pivotal links 40. Similarly, the mast support floor 18 is connected to the low structure 26 by means of two pair of parallel spaced pivotal links 42.

As will be hereinafter described, means are provided for moving support floor structures 18 and 24 to the elevated position illustrated in FIG. 2. The drawworks support floor 24 and links 40 allow the support floor 24 to move in the direction of arrow 44 from the position illustrated in FIG. 1 to the position illustrated in FIG. 2. Once in the elevated position, the support floor 24 is pinned at 46 to the strong back 32 and cross braces 48 are coupled between the base and flange 50 on the lower portion of the support floor 24.

In a similar manner, means are provided for rotating the support floor 18 and links 42 in the direction of arrow 52 from the position illustrated in FIG. 1 to the position illustrated in FIG. 2. This can be accomplished with the mast in the horizontal position illustrated in FIG. 1. Once elevated, the support floor 18 is pinned at 54 to the strong back 32. Cross braces 56 are connected between low structure 26 and a flange 58 on the bottom of support floor 18.

Next, the legs 62 and 64 of gin pole assembly 60 are supported respectively, from the support floors 18 and 24. This gin pole assembly 60 supports elevated sheaves 66. Sheaves 66 are used in rotating mast 12 in the direction of arrow 20 from the horizontal position illustrated in FIG. 1 to the vertical position illustrated in FIG. 2. Mast 12 can be raised by use of the sheaves 66 through the power of drawworks 22 and a wireline coupled to the mast 12.

Figure 3:
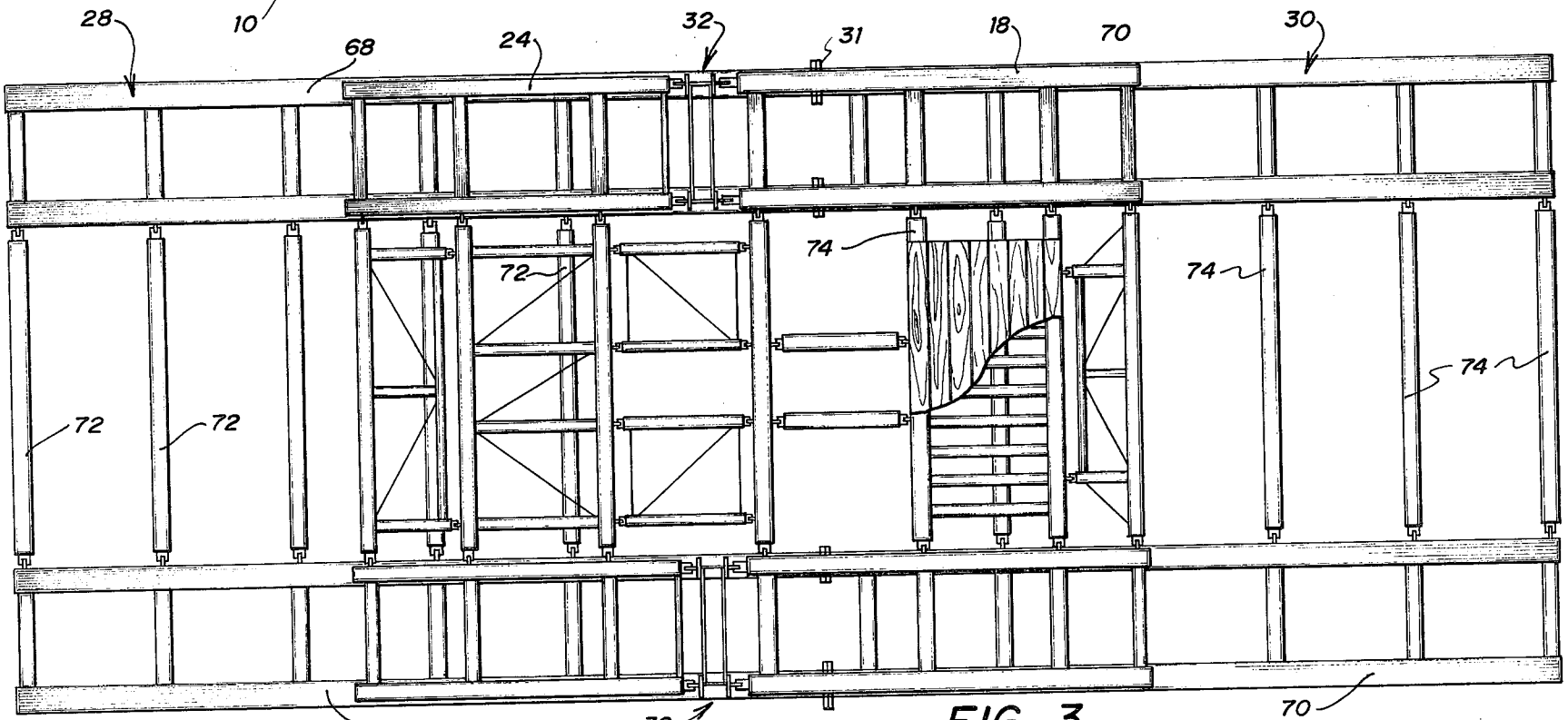
FIG. 3 is a plan view of the support floor and base structure of the modular rig of the present invention.

Details of base structure 26 are illustrated in FIG. 3. Each of the halves 28 and 30 have side members 68 and 70, respectively. Side members 68 are coupled together by cross beam assemblies 72. Each of the side members 70 are coupled together by cross beam assemblies 74.

As can be seen in FIG. 2 the weight of mast 12 and drawworks 22 is supported from the elevated support floors 18 and 24. In this manner the weight of the mast and drawworks is distributed over the elevated supporting floors and in turn, is transmitted down through the links and cross braces to the base structure 26. By supporting mast 12 directly from the elevated support floor, the problems inherent in uneven distribution of weight by reason of the mast being supported from the low structure are minimized.

Figure 4:
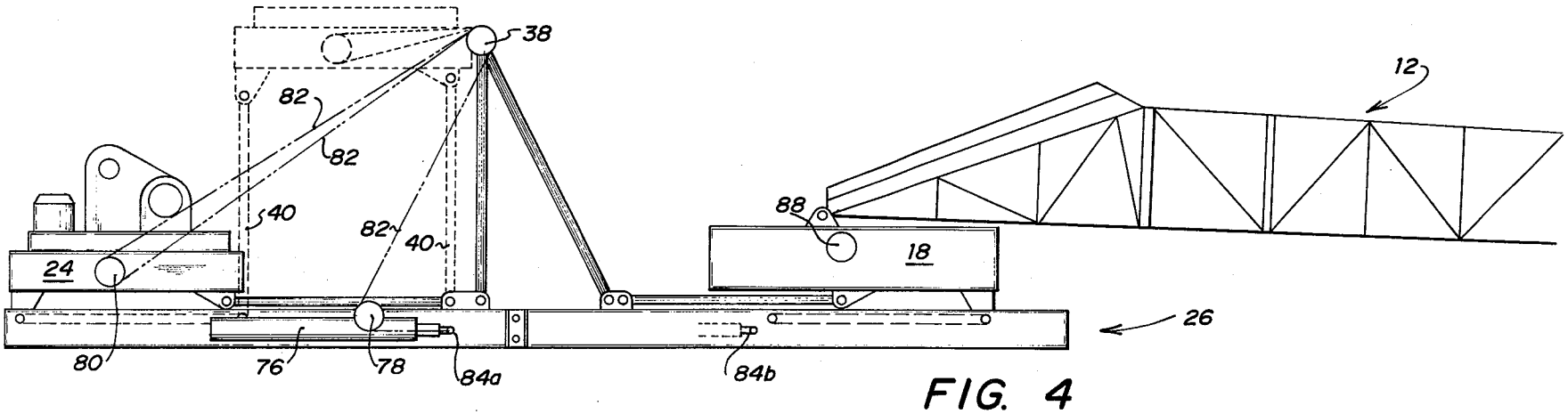
FIGS. 4, 5 and 6 illustrate an embodiment where hydraulic cylinders serve to elevate the support floors.
Figure 6:
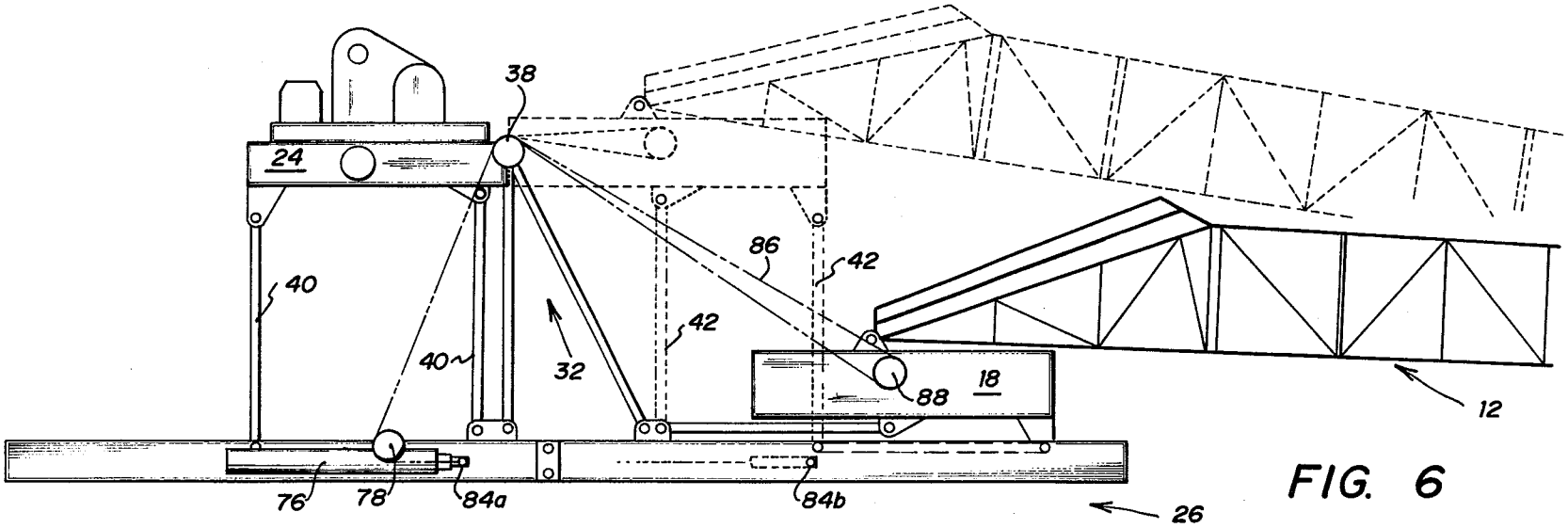
Figure 5:
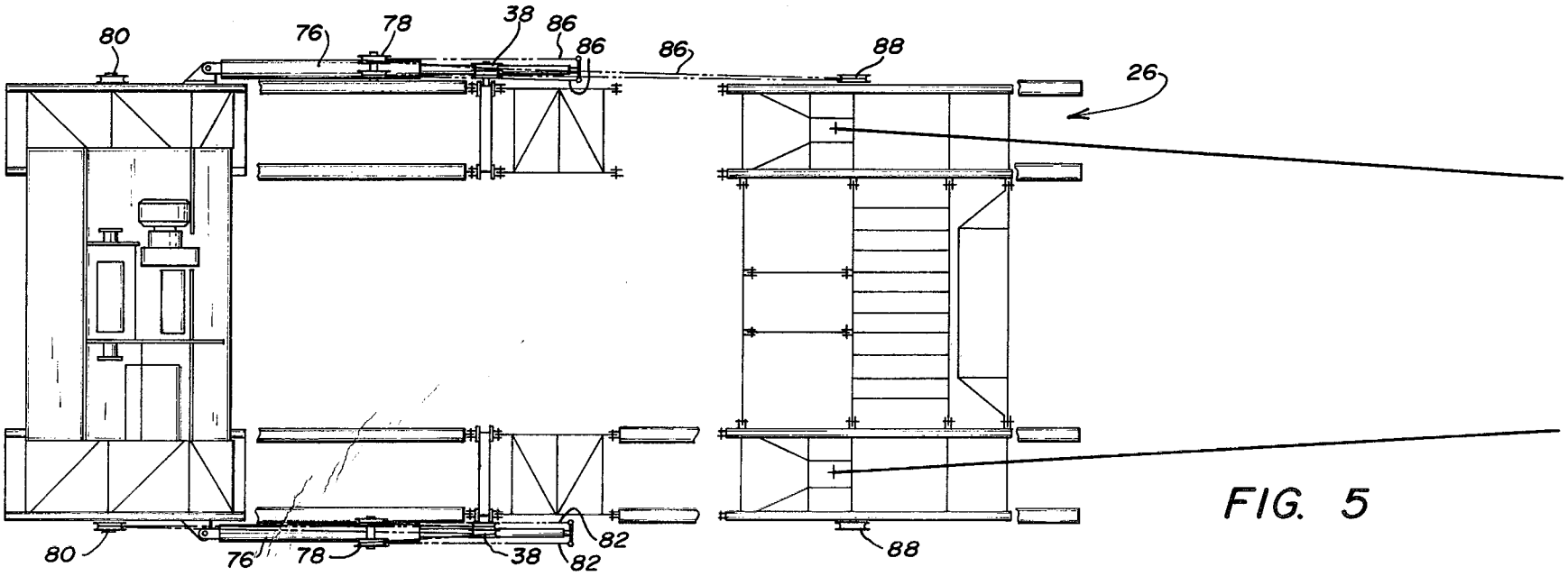

In FIGS. 4, 5 and 6, the system for raising the support floors 18 and 24 is illustrated wherein hydraulic cylinders 76 are mounted on the sides of the base structure 26. Hydraulic cylinders 76 are the double-acting type. Suitable conduits, valving, compressors and other equipment well known are provided to supply pressurized fluids to the cylinders for their selective operation. A pair of sheaves 78 is mounted to straddle each of the hydraulic cylinders 76. Sheaves 80 are mounted on the sides of the support floor 24.

As illustrated in FIG. 4 and the lower half of FIG. 5, a line 82 is attached to cylinder 76. Each of lines 82 may be stranded cable, chain or the like and the associated sheaves are selected to accommodate the particular type of line. Each line 82 has both its ends connected to a piston rod of one of the hydraulic cylinders 76. Lines 82 extend from the piston rod connection along cylinder 76 and passes around sheaves 78. Lines 82 then extend from sheaves 78 over sheaves 38 and are looped around sheave 80. By moving the piston rod from position 84*a* to position 84*b* (illustrated in FIG. 4) support floor 24 will move to the elevated position with links 40. Support floor 24 can then be pinned in place at 46 and cross braces 45 installed to rigidly support the drawworks in the elevated position.

During the process of raising support floor 24, assembly of the sections comprising the mast 12 can be simultaneously taking place. After raising of the support floor 24 for the drawworks assembly 22 is complete, work can begin to raise support floor 18. During this process of raising the support floor 18, assembly of the mast 12 can simultaneously take place and can even be completed after floor 18 is in the elevated position. In addition, during the process of raising support floor 18, work can begin on the drawworks, weather proofing, stairs and other equipment simultaneous with raising floor 18.

One configuration for raising support floor 18 is best illustrated in FIG. 6 and in the upper half of FIG. 5. To raise support floor 18, both ends of line 86 are coupled to the rod 84. Line 86 then passes over two pairs of sheaves 78 and 38. A pair of sheaves 88 are mounted one on each side of support floor 18 and has line 86 looped thereover.

As described with respect to support floor 24, support floor 18 is raised by actuating the hydraulic cylinder 76 to move the piston rod from the position 84*a* to the position 84*b* indicated by dotted lines. This action pulls support floor 18 from the position shown in solid lines to the position shown in dotted lines with links 42 vertical. Support floor 18 can then be pinned in position at 54, FIG. 2, and cross braces 56 installed to rigidly position the support floor 18 in the elevated position.

When the support floor 18 is in the elevated position, work can be started on the rotary table and other equipment on support floor 18 and assembly of the mast 12 can be completed. Thereafter, gin pole assembly 60 can be installed as previously described with respect to FIG. 2 and upon completion of assembly of the mast, the mast can be raised in a conventional manner to the vertical position illustrated in FIG. 2.

From the foregoing, it would be understood that the present invention relates to a modular drilling rig and method of erecting the floors while the mast is connected at its base to one of the elevated support floors. Preferably, the support floors are connected to the base of the rig by means of parallel spaced pivotal legs which allow movement of the support floors to the elevated position with the base of the mast coupled thereto and while the mast is lying in the horizontal position. Hydraulic cylinders are utilized to elevate the support floors preparatory to rotating the mast to its vertical operating position. This system has particular advantage over systems where the mast is supported directly from the base in that it allows work to be performed on the support floors in both the low and elevated positions and during assembly of the mast itself.

It is to be understood, of course, that the foregoing description relates to the preferred embodiments of the present invention and that numerous alterations and modifications of the invention can be accomplished without departing from the spirit and scope of the invention as defined by the accompanying claims.

What is claimed is:

1. In a drilling rig having a base for placement on the ground at a well site with a supporting floor structure releasably connected to the base and supported on parallel spaced legs on each side of said base pivotally attached between the supporting floor structure and the base whereby the supporting floor structure is movable from the base to an elevated position above thhe base upon rotation of the legs to a vertical position, perpendicular to the base, the improvement comprising:

a pair of strong back towers, one mounted on each side of the base near midway the length thereof;

sheave means supported on the top of each of said strong back towers with the axes thereof transverse to the length of the base;

sheave means mounted on said supporting floor structure;

cable means releasably connected to and passing successively said sheave means on said floor structure and over said sheave means supported on said strong back towers; and hydraulic linkage means coupled to said cable means for exerting a force through said cable means for raising the supporting floor structure to the elevated position above the base and adjacent said strong back towers.

2. The drilling rig of claim 1, wherein said supporting floor structure includes:

a first support floor having a drawworks mounted thereon and a second support floor having a mast pivotally mounted thereon, said first and second support floors being independently movable to the elevated position above the base and adjacent said strong back towers by operation of said hydraulic linkage means.

3. The drilling rig of claim 2 wherein said cable means comprises flexible lines releasably connected to said first and second support floors and engaging said strong back tower and means releasably connecting said flexible lines to said drawworks for exerting forces through said lines to raise said first and second support floors to the elevated position above the base.

4. The drilling rig of claim 2 wherein said cable means comprises flexible lines releasably connected to said first and second support floors and engaging said strong back tower and means on said first and second support floors, base and strong back tower for coupling said lines to winch trucks to exert a force through said lines to raise said first and second support floors to the elevated position above the base.

5. The drilling rig of claim 1, and further including:

sheave means mounted on each side of the base over which each cable means passes and in which said hydraulic linkage means comprises hydraulic cylinders mounted on each side of the base wherein each of said hydraulic cylinders are connected to two ends of each of said cable means for pulling said cable means through said sheaves to raise the supporting floor structure.

6. In a drilling rig having a base for placement on the ground at a well site with a supporting floor structure releasably connected to the base and supported on parallel spaced legs on each side of said base pivotally attached between the supporting floor structure and the base whereby the supporting floor structure is movable from the base to an elevated position above the base upon rotation of the legs to a vertical position, perpendicular to the base, the improvement comprising:

a pair of strong back towers, one mounted on each side of the base near midway the length thereof; and means including hydraulic linkage means on each side of the base and mounted to pivot on the base and to be extensible in planes parallel to the parallel spaced legs and coupled between the base and the supporting floor structure for exerting a force for raising the supporting floor structure to the elevated position above the base and adjacent said strong back towers.

* * * * *

UNITED STATES PATENT AND TRADEMARK OFFICE

CERTIFICATE OF CORRECTION

PATENT NO. : 4,135,340

DATED : January 23, 1979

INVENTOR(S) : David F. Cox; Tom T. Hashimoto

It is certified that error appears in the above-identified patent and that said Letters Patent are hereby corrected as shown below:

In the Title: "MODULAR DRILL RIG ERECTION SYSTEMS" should be --MODULAR DRILL RIG ERECTION SYSTEM--.

Column 1, line 48, "most" should be --mast--.

Column 4, line 21, "thhe" should be --the--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*